US005276254A

United States Patent [19]

Breen et al.

[11] Patent Number: 5,276,254

[45] Date of Patent: Jan. 4, 1994

[54] PROCESS TO STABILIZE SCRUBBER SLUDGE

[75] Inventors: Bernard P. Breen, Pittsburgh, Pa.; James E. Gabrielson, Plymouth, Minn.; Robert A. Schrecengost, Brooklyn, N.Y.

[73] Assignee: Consolidated Natural Gas Service Company, Inc., Pittsburgh, Pa.

[21] Appl. No.: 868,701

[22] Filed: Apr. 15, 1992

[51] Int. Cl.[5] ..... C22B 1/14

[52] U.S. Cl. ..... 588/256; 23/313 AS; 588/257

[58] Field of Search..... 106/DIG. 1; 106/707, 782; 588/252, 256, 588/257; 110/345; 23/313R, 313AS; 423/DIG. 20

[56] References Cited

U.S. PATENT DOCUMENTS

| | | | |
|---|---|---|---|
| 4,153,655 | 5/1979 | Minnick et al. | 264/8 |
| 4,306,903 | 12/1981 | Beggs et al. | 75/10.38 |
| 4,977,837 | 12/1990 | Roos et al. | 110/345 |
| 5,019,360 | 5/1991 | Lehto | 423/132 |
| 5,041,398 | 8/1991 | Kauser et al. | 501/27 |

*Primary Examiner*—Michael Lewis
*Assistant Examiner*—Stephen G. Kalinchak
*Attorney, Agent, or Firm*—Buchanan Ingersoll; Lynn J. Alstadt

[57] ABSTRACT

A process for stabilizing sludge containing flyash and calcium sulfate formed by a lime or limestone scrubber increases the sludge particles to a size at which leaching of toxic metals from the particles no longer occurs at toxic levels. The sludge is dewatered and injected into the furnace in a manner to cause the flyash to soften and stick together. The agglomerated particles then fall into a bottom ash pit for removal as a common waste.

20 Claims, 3 Drawing Sheets

PROCESS TO STABILIZE SCRUBBER SLUDGE

BACKGROUND OF THE INVENTION

1. Field of the Invention

The present invention relates to a process for making scrubber sludge stable so that it can be safely disposed. More specifically, the process relates to fusing or combining together the many small particles of gypsum and flyash in the scrubber sludge by injecting them into a boiler and heating them sufficiently to soften or melt their surfaces and impinging them on each other, or even to melting the small particles together and having the resulting larger agglomerates fall out the bottom of the boiler.

2. Description of the Prior Art

In the production of electricity by steam, very often coala is burned to supply the heat to raise the steam. Coal contains sulfur; some coal contains a little sulfur and some a lot, but all coal contains sulfur. As the coal is burned the sulfur is burned to sulfur dioxide ($SO_2$). The $SO_2$ is a gas and it goes out of the stack with the other products of combustion. Some sulfur may be discharged from the mills as pyrite and a small amount can be retained in the ash, but most of the sulfur in the coal exits the boiler as the gas, $SO_2$. This gas is an air pollutant, is not healthy to breathe, contributes to smog, and is oxidized in the atmosphere to sulfur trioxide which combines with water to form the corrosive and acidic component of acid rain, sulfuric acid. As a result there are numerous local, state and federal laws and regulations limiting the emissions of sulfur dioxide. A response to such regulations which is often followed in large electric power plants is to install sulfur scrubbers.

Typically these scrubbers contact a slurry of lime or limestone with the flue gas from the combustion process. Usually the by-product is gypsum, $CaSO_4.2H_2O$, slurried in water and mixed with the flyash which is typically removed from the gas by the slurry in the scrubber. Thus the by-product of the scrubber is a sludge containing large amounts of water, gypsum, and flyash. The product, of course, is clean flue gas. Various efforts have been made to convert the sludge into useful plaster of Paris, wall board, or other useful products, and some have had limited success. However, the great bulk of the sludge must be disposed. The sludge is often disposed near the power plant in ponds or impoundments, but on occasion it may be transported some distance and placed in landfills.

The sludge contains mineral matter which has various solubilities in water. Some toxic metals are among that mineral matter. However, the United States Environmental Protection Agency has determined that the state of being hazardous depends upon extraction rates of the toxic metals. This in turn depends, among other things, on particle size. Unfortunately the flyash that is collected in the sludge may have a mass mean particle diameter as low as 20 micrometers. These very small particles have a large surface area to volume ratio and can be expected to be more easily leached than larger particles.

Bottom ash, due to its larger size, will be less of a leaching hazard. The United States Environmental Protection Agency has established extraction tests to determine if coal ash is hazardous. The present procedures are set forth in 40 CFR 260.20 and 260.21. It is emphasized that the test of ash for being hazardous is based on how much of a given element is extractable from a sample, not on how much is in a sample. The sample is crushed to pass a ⅜-inch (9.5 mm) sieve and extracted with water to which acetic acid is added to keep the pH at 5.0. The sample is contacted with the weak acid for 24 hours, after which time the liquid is tested for metals. The extract is tested for arsenic, barium, cadmium, chromium, lead, mercury, selenium, and silver. A concentration limit is specified for each metal and if one exceeds the specified limit the ash is considered as having EP Toxicity and considered a hazardous waste. It is well known that disposal of hazardous waste is very expensive and should be avoided if possible.

It is true and recognized by people familiar with the arts of extraction and lixiviation that soluble materials are much more readily extracted from small particles than from large particles. Because small particles have higher surface area/volume ratios than large particles, a higher proportion of the soluble materials are at the surface of the particle and come into contact with the extraction liquid. Therefore, ash with large particles will often be judged non-toxic, while the same ash having small particle sizes would be found to be toxic. Thus, by increasing the size of ash particles they can be made more safe for disposal. Because of their small size the sample crushing procedure specified in the test is not relevant to flyash particles. It would take over 100 million spheres of flyash which on average is 20 micrometers in diameter to make one, 9.5 millimeter diameter sphere.

SUMMARY OF THE INVENTION

We provide a system for sludge stabilization in which the sludge is introduced to the lower part of the furnace, is dewatered, dried, dehydrated, and at least part of the sludge is fused or melted. The fusing or melting causes most of the particles to grow into agglomerates which are much larger in size than the flyash or the gypsum crystals which were formed in the scrubber. The agglomerates of ash and flyash pass out the lower part of the furnace as bottom ash. The gypsum is substantially converted to anhydride, $CaSO_4$.

In one embodiment, the sludge containing gypsum and collected flyash is substantially dewatered and returned to the furnace by a carrier gas, usually air. As the sludge and carrier stream is injected into the furnace, often an auxiliary fuel, preferably natural gas, is mixed with the carrier to burn and fuse the flyash in the sludge. Usually the carrier air will be sufficient to burn the auxiliary fuel, and if it is not, the oxygen in the combustion products from the primary burners can be used to help burn the auxiliary fuel. At times it may be desirable to add air with the fuel. An ignitor may be required. The stream of fused or softened and sticky flyash, calcium sulfate and carrier gas can be directed towards a furnace wall; or if the flyash particles are soft enough to stick together with the calcium sulfate on impact, the stream can be directed so the agglomerates fall into the bottom hopper which is usually filled with water. In this manner the sludge will be converted to a stable product which can be easily dewatered.

In a second embodiment, the sludge is pumped as a water slurry into the lower part of the furnace. The sludge is formed as a water slurry and this may be the easiest method of handling it. It is dewatered to the extent consistent with the difficulty of removing water from the sludge and with the difficulty of pumping very thick sludges. The sludge is pumped or atomized into the lower part of the furnace where the hot surrounding gases evaporate the water, drive the waters of hydration from the gypsum, heat the ash and anhydride, and finally soften or melt at least part of the ash. If the gases are not hot enough to accomplish this task, it will be necessary to add a fuel and air to combust the fuel at the injection point. An ignitor may be required. The stream of fused or softened and sticky flyash, calcium sulfate, and gases can be directed towards a furnace wall; or if the flyash particles are soft enough to stick with each other and the calcium sulfate on impact, the stream can be directed so the agglomerates fall into the bottom hopper which is usually filled with water. In this manner the sludge can be easily converted to a stable product which is easily dewatered and from which the metals will only be slowly leached.

Both embodiments have increased the particle size of the flyash sludge thereby reducing the leaching rate of toxic metals from the sludge. Such a change will make it possible to now dispose of the sludge as normal wastes rather than as hazardous wastes. Our process is also useful for coal furnace sludges which are not hazardous. Even though these sludges are not hazardous wastes, their disposal requires very expensive pond linings and other leachate control efforts. Our process will make these procedures unnecessary.

DESCRIPTION OF THE PREFERRED EMBODIMENTS

Figure 1:
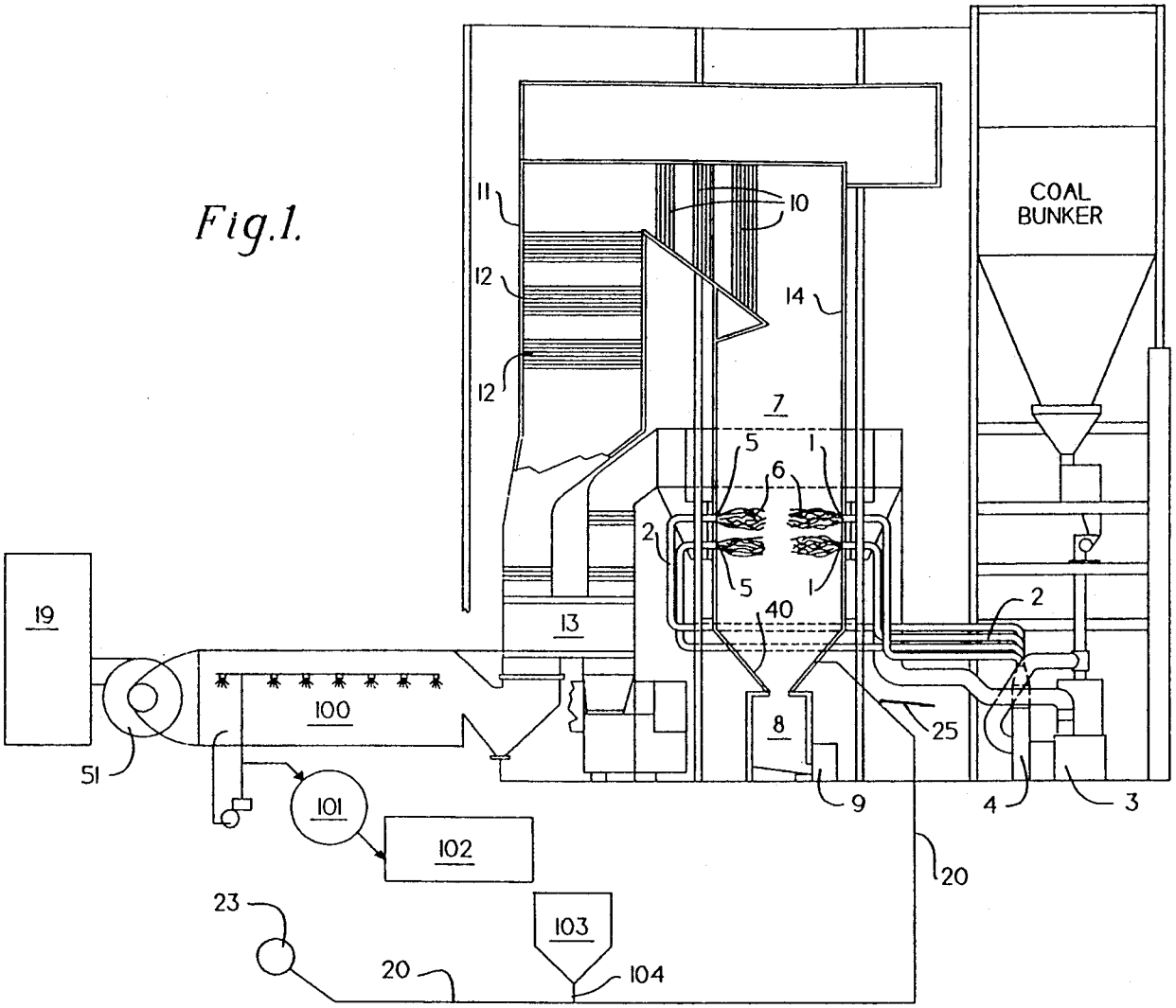
FIG. 1 is a diagram of a prior art pulverized coal burning furnace and boiler apparatus with a scrubber modified to fit our method.

Referring to FIG. 1, a furnace having at least one burner is shown. The furnace could be a stoker, a cyclone boiler or a coal fired furnace like that diagramed in FIG. 1. A stream of pulverized coal is blown into the burner 1 through coal pipes 2 after the coal was pulverized in mill 3 and drawn from the mill by exhauster 4. The coal may be bituminous, anthracite, subbituminous, lignite or any combination thereof. Secondary air is introduced through an annular opening 5 around the primary air-coal pipe to burn the coal. Primary flames 6 are produced. The combustion products, along with most of the ash, fill the furnace 7 while some of the ash sticks to the walls and falls off or is removed by soot blowers (not shown) to fall in the ash pit 8. The ash pit is largely filled with water. From the ash pit the ash is crushed and pumped by pump 9 along with carrier water to a recovery or disposal area (not shown). Combustion gases and flyash travel through the superheater and reheater sections 10 if they are part of the boiler. They then travel through boiler 11 and economizer sections 12 if the furnace is so fitted. From the economizer the gases travel through the air heater 13. The hot combustion products give up much of their heat first to the water walls 14 where water is heated and converted to steam, then to superheater and reheater sections where steam is heated, then to a boiler where steam is made from water, then to an economizer where water is heated, and finally to the air heater where air is heated. The preferred embodiment may not always include all of these elements. For instance, not all boilers have reheaters, nor superheaters, nor convective pass boilers 11, nor air heaters, and some do not have economizers. In addition, the order may be different than the one shown here. This is the most common arrangement. From the air heater the gases flow to a scrubber 100 where the gas is contacted with a slurry of limestone or lime to remove the flyash and sulfur dioxide. From this point the gases flow to the stack 19 via an induced draft fan 51.

We remove much of the water from the slurry by use of a filter 101 and dryer 102, if necessary, or other suitable means and recycle the dewatered sludge. Our recycling process utilizes pressurized carrier gas in line 20 supplied by a fan or compressor 23 to educt the dewatered sludge from the hopper 103 through conduit 104. A fluxing agent such as an iron containing material or slag from iron or steel making processes could be added to the dewatered sludge in hopper 103 or by injection into conduit 104. One could also add a material such as sodium sulfate which melts and sticks the sludge together. The dewatered sludge is then conveyed to the furnace 7 and directed at the lower hopper 40, which while it is sloped is formed from water wall tubes. The carrier gas may be air, flue gas, natural gas, steam, or other gas, but is preferably air. An auxiliary fuel such as natural gas, coal or liquified petroleum gas is injected through line 25 into the carrier gas 20 causing combustion and softening or fusion of the flyash. The ash and calcium sulfate impinge on the opposite hopper at which time it is desirable that it be sticky. The ash and sludge which is agglomerated in this manner will be a stable product.

Figure 2:
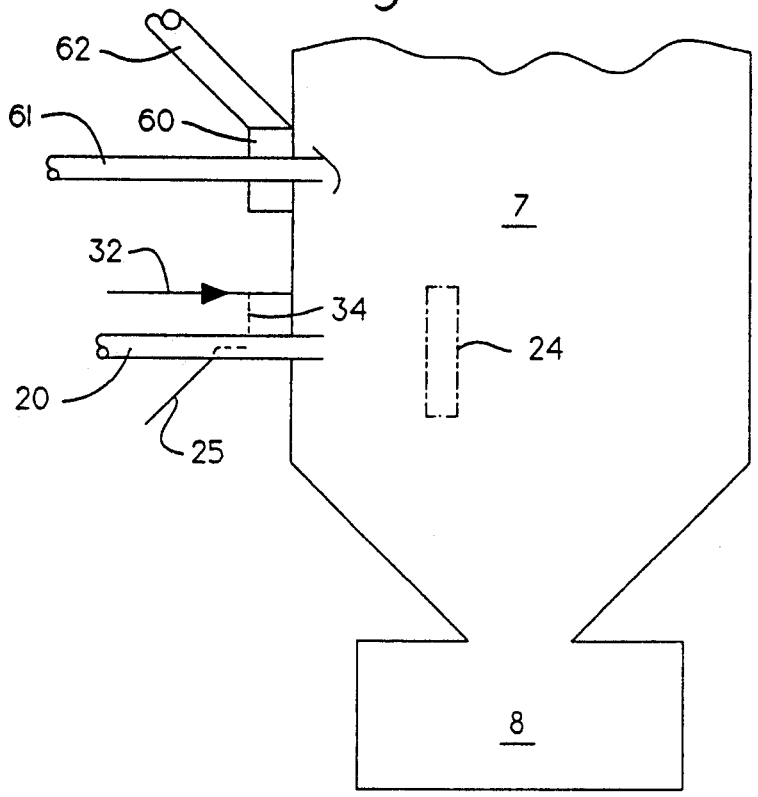
FIG. 2 is a more detailed diagram showing sludge being injected into the bottom of the furnace using a gas carrier.

As illustrated in FIG. 2, the dewatered sludge is injected into the furnace in a stream of carrier gas through a primary line 20. This stream is mixed with fuel through line 25, which is preferably natural gas, and with additional air if necessary which enters through a secondary inlet 32. Line 25 may extend into line 20 to introduce the fuel into the center of the dewatered sludge and carrier gas stream. Air inlet 32 could also introduce air into such stream as indicated by dotted line 34. The amount of additional air required may be 0.5 to 5 pounds per pound of dry sludge. Combustion occurs which softens the ash and makes it sticky. Inlets 20 and 32 are positioned to direct the stream against the opposite wall or against the opposite slope of the furnace or against a special target 24 (shown in chain line) placed within the furnace. Also shown in FIG. 2 is a primary burner 60 with a coal pipe 61 through which coal and primary air flow and an inlet 62 for secondary air.

It is necessary to soften the flyash so it will stick together, but the flyash cannot be melted. If the flyash melts completely, even with the still solid calcium sulfate as a diluent, it will probably stick tenaciously to the furnace walls and it may not be possible to remove it without taking the boiler out of service. The lost production is very expensive and the removal of previously molten ash or slag is difficult and can require dynamite. Thus, it is necessary to soften or make the ash particles sticky without melting them. Flyash is a mixture of compounds, and like most mixtures transforms from a solid to a liquid over a large temperature range. In contrast, most pure compounds melt at a single temperature so it would be impossible to soften them without melting them. Table 1 shows the various temperatures for different points on the solid-liquid transformation progression for three coals. The ash samples are shaped into cones and in this case heated under an atmosphere containing no oxygen, but containing some fuel. The results are called Ash Fusion Temperatures (Reducing Conditions). The first, second and fourth headings should be obvious, and the third one is the temperature at which the cone has assumed the shape of the top half of a sphere.

TABLE 1

| | Ash Fusion Temperatures for Three Coals | | | |
|---|---|---|---|---|
| Coal | Initial Deformation | Softening H = W | Hemispherical H = ½ W | Fluid °F. |
| 1 | 2400 | 2550 | 2590 | 2700+ |
| 2 | 2010 | 2175 | 2215 | 2495 |
| 3 | 2205 | 2363 | 2403 | 2598 |

This table shows that the fusion of the ash from these coals takes place over a temperature range of at least 300° F. up to almost 400° F. Thus it is possible to bring ash to softness without melting it. Comparing the second sample to the first it is seen that there is a great deal of difference between coals. As one might expect, individual coals will give different results at different times. Consequently, as a coal changes, it may be necessary to adjust the amount of auxiliary fuel used to soften the ash.

In the case of many coals it may be desirable to use a fluxing agent to reduce the fusion temperature of the ash or simply to provide a fluid phase which will serve to stick the solid ash and calcium sulfate particles together.

In the main we do not wish to melt the calcium sulfate. The calcium sulfate should only be heated to drive off the water, convert the gypsum to anhydride and coat it with molten or sticky ash, resulting in agglomerates. The coating will reduce leaching rates and the size increase will also reduce leaching rates of the calcium sulfate. More importantly, the size increase of the flyash particles will reduce the leaching rates of the flyash which is the source of the toxic metals. These changes will make it possible to dispose of the materials normally in the sludge as common wastes rather than as hazardous wastes.

Figure 3:
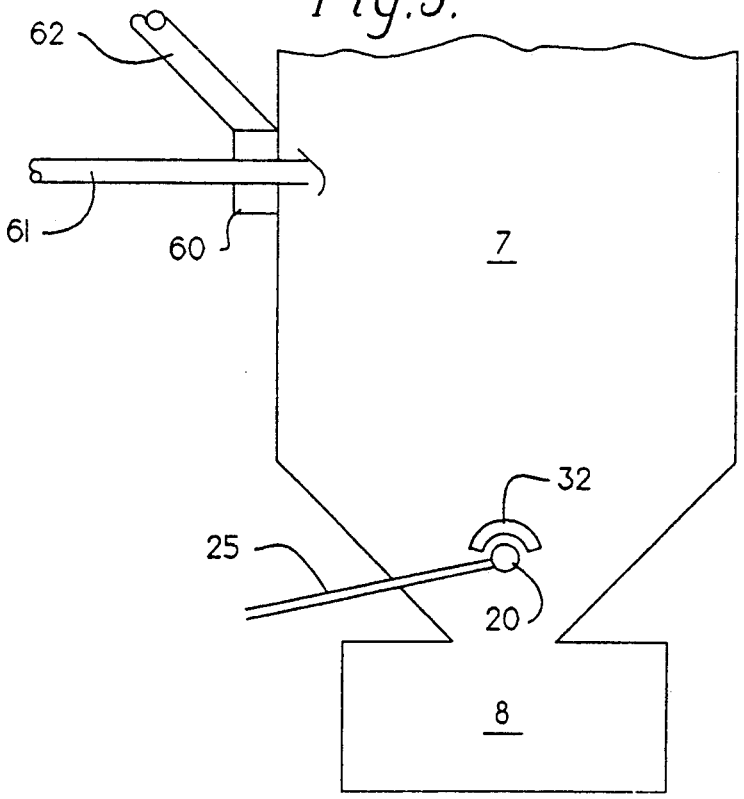
FIG. 3 is a more detailed diagram showing sludge being injected into the bottom of the furnace so the agglomerates fall directly into the ash pit.

Our method can also be practiced by injecting the ash so it falls directly out of the bottom of the furnace into the water in the ash pit 8 (FIG. 3). In this case it is possible to heat the ash until it is completely melted since it will have no chance of sticking to the walls. However, we do not intend to melt the anhydride.

One pound of dewatered sludge may require one pound of air as carrier gas. The air and dewatered sludge may require 1800 Btu or 1.8 cubic feet of natural gas to raise the ash to softening temperature. This amount of natural gas is about 40% more than can be burned by one pound of air. The difference can be made up by using 1.4 pounds of carrier air per pound of dewatered sludge, adding secondary air, or by relying on residual oxygen in the furnace to complete the combustion of the natural gas or other fuel.

Figure 4:
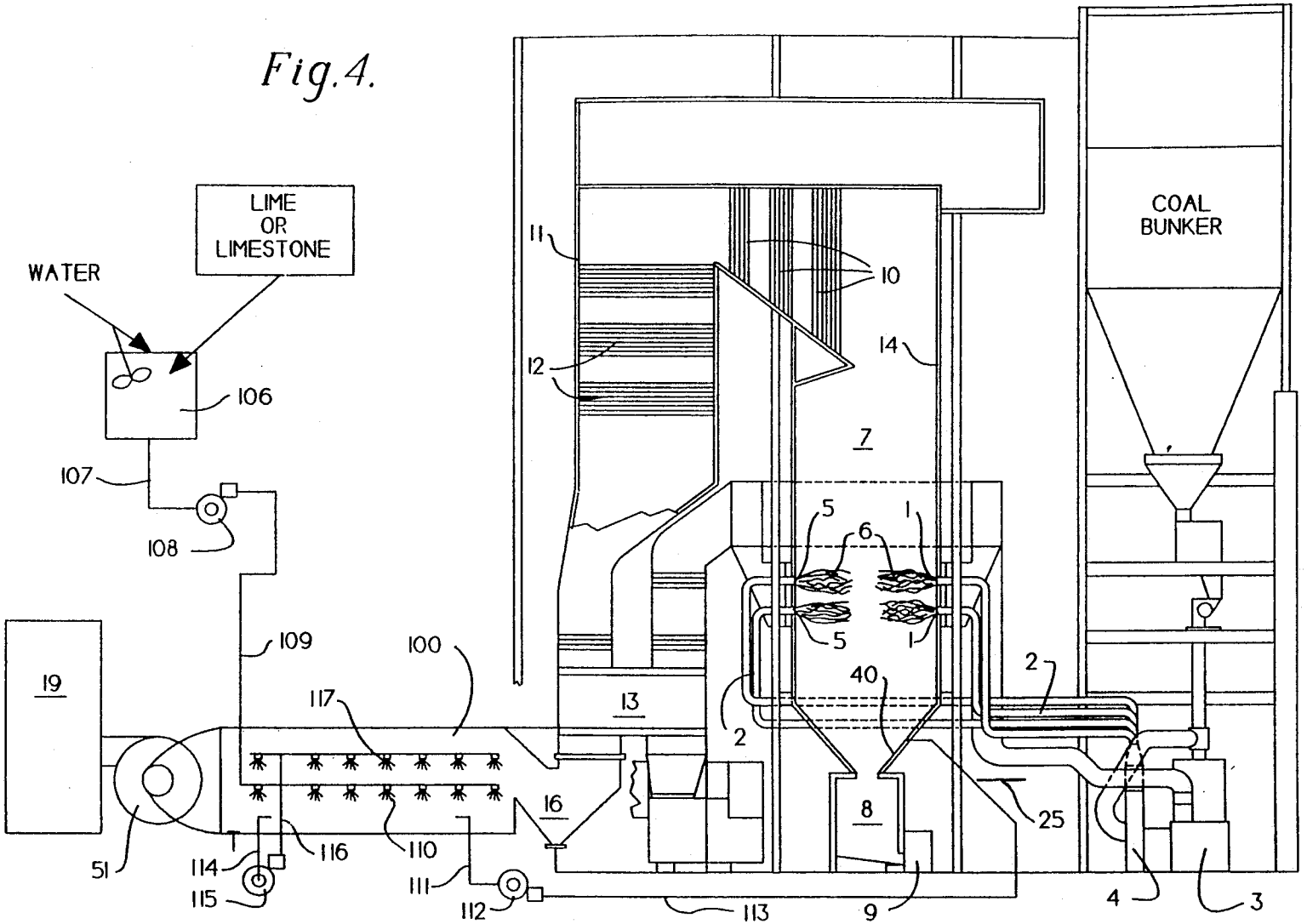
FIG. 4 is a more detailed diagram showing sludge being injected as a water slurry, according to our second preferred embodiment of the invention.

Referring to FIG. 4, a furnace having at least one burner is shown. A stream of pulverized coal is blown into the burner 1 through coal pipes 2 after the coal was pulverized in mill 3 and drawn from the mill by exhauster 4. The coal may be bituminous, anthracite, subbituminous, lignite or any combination thereof. Secondary air is introduced through an annular opening 5 around the primary air coal pipe to burn the coal. Primary flames 6 are produced. The combustion products along with most of the ash fill the furnace 7 while some of the ash sticks to the walls and falls off or is removed by soot blowers (not shown) to fall in the ash pit 8. The ash pit is largely filled with water. From the ash pit the ash is crushed and pumped by pump 9 along with carrier water to a recovery or disposal area (not shown). Combustion gases and flyash travel through the superheater and reheater sections 10 if they are part of the boiler. They then travel through boiler 11 and economizer sections 12 if the furnace is so fitted. From the economizer the gases travel through the air heater 13. The hot combustion products give up much of their heat first to the water walls 14 where water is heated and converted to steam, then to superheater and reheater sections where steam is heated, then to a boiler where steam is made from water, then to an economizer where water is heated, and finally to the air heater where air is heated. The preferred embodiment may not always include all of these elements. For instance, not all boilers have reheaters, nor superheaters, nor convective pass boilers 11, nor air heaters, and some do not have economizers. In addition, the order may be different than the one shown here. This is the most common arrangement. From the air heater the gases flow through a sharp bend 16 where some of the flyash may be collected. From this point the flyash and gas pass into a srubber 100 and from the scrubber into the stack 19 via an induced draft fan 51.

In the scrubber 100 of FIG. 4, the gas is contacted with recycled sludge, water and limestone or lime which flows out the bottom of the scrubber via line 114 to pump 115 which pumps the slurry through line 116 to the nozzles 117 where it is sprayed through the gas. Make-up lime or limestone is mixed with water in tank 106. The make up slurry flows from tank 106 via line 107 to pump 108 which pumps it through line 109 to nozzles 110 where it is atomized and contacts the flue gas. Spent slurry is removed from the scrubber by line 111 to pump 112 which pumps it via line 113 into the bottom of the boiler.

Example 1

A 600 MW electrical generating unit with a heat rate of 9500 Btu/kWh firing 12,000 Btu/lb coal will use 475,000 lb/hr (238 t/hr) of coal, If the coal is 12% ash and 80% of the ash shows up as flyash the unit will produce 45,600 lb/hr of flyash. If the coal also contains 3.73% sulfur, this is 17,739 lb/hr which will be scrubbed out as 95,434 lb/hr of gypsum. Assuming the scrubber removes 99% of the ash and 90% of the sulfur, it will recover 45,144 pounds of ash and produce 85,890 pounds of gypsum. If the solids also include 4% of unreacted limestone or lime and other materials, the total solids generated is 136,275 lbs/hr (68 t/hr). At 6700 hrs/yr operation at full load, the unit would produce 456,522 t/yr. As sludge this contains several pounds of water per pound of solid. However, it can be dewatered to two pounds of water to one pound of solid. Then there are 1,369,600 t/yr of dewatered sludge. At a rate of 1.8 cubic feet of natural gas per pound of dewatered sludge, this requires about 4,936,000,000 cubic feet per year of natural gas. At $2.5 per thousand cubic feet of natural gas, the cost would be around $12,340,000 per year. If the coal costs $1.5 per million Btu and 40% of the above gas goes to replace coal, the reduction in coal cost would be (4,936,000)×(0.4)×(1.5)=$2,962,000. On the other hand, the cost of disposal of 1,369,600 tons of hazardous waste annually could be conservatively $30,000,000, while the disposal of 1,369,600 tons of non-hazardous waste would be no more than $14,000,000. Thus a net savings of $6,622,000 can be made.

The invention is not limited to the described preferred embodiments but may be practiced within the scope of the claims.

We claim:

1. A process for the elimination of sulfur scrubber sludge from a coal fired furnace having a lime or limestone scrubber, the process comprising the steps of:
   (a) forming a sludge containing flyash and calcium sulfate in the scrubber;
   (b) dewatering the sludge;
   (c) removing the dewatered sludge with a stream of carrier gas to form a stream of carrier gas and dewatered sludge;
   (d) adding a fuel to the stream of carrier gas and dewatered sludge; and
   (e) introducing the carrier gas, dewatered sludge and fuel into the furnace in a manner so that heat from burning the fuel in the presence of an oxidant and heat from at least one of surrounding gas and slag provides energy to heat and soften the flyash and causes the softened flyash to agglomerate with the calcium sulfate and fall into a bottom ash pit.

2. A process as described in claim 1 wherein the carrier gas is at least one gas selected from the group consisting of air, flue gas, natural gas and steam.

3. A process described in claim 1 wherein the fuel is a fuel selected from the group consisting of natural gas, coal and liquified petroleum gas.

4. A process as described in claim 1 wherein the fuel is introduced centrally within the dewatered sludge and carrier gas.

5. A process as described in claim 1 further comprising the step of adding additional air to the dewatered sludge.

6. A process as described in claim 5 wherein the additional air is added as a carrier gas for the dewatered sludge.

7. A process as described in claim 1 wherein a portion of the oxidant for the fuel is oxygen from the surrounding products of combustion.

8. A process as described in claim 7 wherein all of the oxidant for reaction with the fuel comes from the surrounding products of combustion.

9. A process as described in claim 1 wherein the furnace is selected from the group consisting of of a stoker, a pulverized coal fired furnace, and a cyclone boiler.

10. A process described in claim 1 where and the coal is comprised of at least one type of coal selected from the group consisting of bituminous, anthracite, subbituminous, and lignite.

11. A process as described in claim 1 wherein the dewatered sludge is directed toward a wall of the furnace.

12. A process as described in claim 1 wherein the furnace has a bottom slope and the dewatered sludge is directed toward a bottom slope of the furnace.

13. A process as described in claim 1 wherein the dewatered sludge is directed so it falls directly into an ash pit.

14. A process as described in claim 1 wherein a fluxing agent is added to the dewatered sludge.

15. A process as described in claim 14 wherein the fluxing agent is an iron containing material.

16. A process as described in claim 14 wherein the fluxing agent is slag from iron or steel making processes.

17. A process as described in claim 1 wherein a melting material which sticks the dewatered sludge together is added to the dewatered sludge.

18. A process as described in claim 17 wherein the melting material is sodium sulfate.

19. A process for the elimination of sulfur scrubber sludge from a coal fired furnace having a lime or limestone scrubber, the process comprising the steps of:
   (a) forming a sludge containing flyash and calcium sulfate in the scrubber;
   (b) dewatering the sludge;
   (c) removing the dewatered sludge with a stream of carrier gas and a fuel to form a stream containing carrier gas, fuel, and dewatered sludge; and
   (d) introducing the stream of step (c) into the furnace in a manner so that heat from the surrounding gas provides energy to heat and soften the flyash and causes the softened flyash to agglomerate with the calcium sulfate and fall into a bottom ash pit.

20. A process as described in claim 1 wherein a special target is placed in the furnace for the dewatered sludge to strike.

* * * * *